United States Patent [19]

Roos et al.

[11] Patent Number: 4,831,747

[45] Date of Patent: May 23, 1989

[54] CONTINUOUS DRIER FOR VENEER

[75] Inventors: Friedrich Roos, Hauneck; Peter Brod, Mecklar; Wilfried Möller, Friedewald, all of Fed. Rep. of Germany

[73] Assignee: Babcock-BSH Aktiengesellschaft Vormals Buttner-Schilde-Haas AG, Krefeld, Fed. Rep. of Germany

[21] Appl. No.: 123,126

[22] Filed: Nov. 20, 1987

[30] Foreign Application Priority Data

Nov. 22, 1986 [DE] Fed. Rep. of Germany ..... 3639929

[51] Int. Cl.[4] ..... F26B 21/12

[52] U.S. Cl. ..... 34/54; 34/29; 34/44; 34/89; 34/216

[58] Field of Search ..... 34/54, 52, 29, 30, 31, 34/44, 45, 89, 216

[56] References Cited

U.S. PATENT DOCUMENTS

| | | | |
|---|---|---|---|
| 3,350,789 | 11/1967 | Davies | 34/48 X |
| 3,625,812 | 12/1971 | Gudaz | 34/54 X |
| 3,959,723 | 5/1976 | Wagner | 324/61 P |
| 4,170,073 | 10/1979 | Ignatowicz | 34/216 X |
| 4,183,292 | 1/1980 | Banks | 34/50 X |
| 4,204,337 | 5/1980 | Roos et al. | 34/44 X |
| 4,494,315 | 1/1985 | Roos et al. | 34/54 X |

FOREIGN PATENT DOCUMENTS

| | | |
|---|---|---|
| 2721965 | 3/1980 | Fed. Rep. of Germany . |
| 3121348 | 1/1984 | Fed. Rep. of Germany . |

*Primary Examiner*—Harry B. Tanner

*Attorney, Agent, or Firm*—Herbert Dubno

[57] ABSTRACT

The invention relates to a continuous dryer for veneer. In addition to temperature sensors near the inlet and middle zones to determine heat demand and to control heat input in these zones, the dryer also has an infrared detector at the exit end to determine surface temperature and thus to determine residual moisture of the veneer. The signal from this infrared detector is processed to give a control signal for blowers in the drying zones near the exit. By this means, more precise and reliable control in final moisture is achieved. Variations in dryer load, initial moisture, wood density, and sheet thickness can be better tolerated.

8 Claims, 2 Drawing Sheets

CONTINUOUS DRIER FOR VENEER

FIELD OF THE INVENTION

Our present invention relates to a continuous drier for veneer. The drier is provided with means for maintaining the moisture of the veneer within desirable limits despite wide variations in dryer load and other input variables.

BACKGROUND OF THE INVENTION

In the continuous drying of veneer sheets, a specific problem occurs which is not usually encountered in other drying processes. Two factors which determine the amount of water evaporated are subject to wide variations, namely the starting moisture level of the veneer sheets and the density of the load on the conveyer (i.e. the number of panels per unit time or per unit length of conveyer). Correspondingly, the drying efficiency must be varied over a wide range in order to match the constantly varying demand.

As a solution to this problem, it was proposed in German Patent DE-PS No. 27 21 965 to use a control process wherein the local heat consumption in at least two zones of the dryer was to be continually measured by measurement of the drop in temperature of the ambient air stream. From this measurement, determination could be made of the local heat demand in reference to the loading density and the initial moisture level. With the aid of a computer, the temperature and/or the throughput velocity is calculated and the appropriate control signal is generated for the heating regulator and/or for the drive motor of the conveyer.

Since the temperature can be varied only over a narrow range for any given kind of wood, and since the temperature changes occur only very slowly due to the large heat capacity of the apparatus, only very rough control of temperature is actually practicable. Control of the conveyer speed has a major influence on the total output of the factory, and in a continuous production line, such control can only be done in close coordination with the work stations located before and after the dryer. Therefore, it is preferable to avoid unnecessary changes of the conveyer speed. For this reason, it has been proposed in German Patent Application DE-OS No. 31 21 348 that the rotation speed of the blowers be controlled in accordance with the measured heat demand.

By means of the aforementioned process, it is possible to hold the final moisture level within a small tolerance range even where large variations occur in the initial moisture level and in the operating load. However, intolerable variations of the final moisture level occasionally occur due to disturbing influences. One of these disturbing influences relates to the fact that the thickness of the veneer sheets varies to a certain extent. These thickness variations not only influence the amount of moisture to be vaporized but they also affect the rate of drying as the diffusion distance increases or decreases. By experience, it is found that an increase in thickness of 10% leads to nearly a 20% slowing of the drying speed. Since the tolerated thickness variations cannot be measured in any practical way and indeed are practically unmeasurable, these variations cause deviation of the final moisture level from the initially computed level. Another disturbing influence is the differing density of the raw wood, which also leads to practically unavoidable variations of the final moisture level away from the desired value.

From U.S. Pat. No. 3,350,789 it is known that the moisture level of thin porous goods, for example veneer sheet, can be determined from the emitted radiant heat, taking account of the drying conditions, by means of a computation using an empirically determined formula. Moreover, it is known to use a dryer for continuous web goods which has two successive zones. In the first zone, the temperature and gas velocity are held constant. A radiation measuring device is placed at the end of the first zone. The measured value is compared to a desired setting, and the difference serves as a control signal for the heater or the blower of the second zone.

The aforementioned dryer is perhaps suited for the drying to constant moisture of continuous web goods, the initial moisture level of which varies within certain limits of tolerance. However, as a rule, it is practically impossible to get the moisture content of veneer sheets to approach close enough to a preset value under constant drying conditions in the first zone, in order that remaining differences can be overcome in the second zone, using the control process just described. The varying load is not measured by this radiation measuring device, and therefore is not compensated for. Moreover, in the patent referred to, no reference is made to the fact that the functional relationship between surface temperature and residual moisture is only valid below the fiber saturation point, which for most types of wood is in the range of 25 to 40%. If one attempts to use this prior art drying method for the drying of veneer, it would be impossible to assure that at the end of the first zone, all of the veneer sheets would have reached the fiber saturation point, without somehow taking into account the starting moisture level and the load. Above the fiber saturation level, the material temperature is practically independent of its moisture level; the drying process runs in accordance with the cooling boundary temperature.

OBJECT OF THE INVENTION

The present invention has as its object to make available a type of continuous dryer for veneer which reduces to tolerable limits the variation of the final moisture level away from a preset value, even in the presence of the aforementioned disturbing factors.

SUMMARY OF THE INVENTION

These results are accomplished, in accordance with the invention, by the following means, most broadly stated: The dryer comprises an enclosure with an inlet and an outlet for veneer and means for moving the veneer from the inlet to the outlet of said enclosure. This enclosure has means for circulating heated gases at a controllable rate for drying the veneer and means for controlling the flow rate of the gases. Moreover, at the outlet of the dryer an infrared sensor is situated to determine the residual moisture of the veneer exiting the drier. This sensor supplies an input signal, which after suitable electrical conversion by well known signal conversion means, supplies an operating output signal for adjusting the blower velocity, thus controlling the final moisture content of the veneer by controlling the final stages of drying near the output end of the dryer.

In somewhat more detail, a useful embodiment of the invention comprises an enclosure, a conveyer for veneer extending through the enclosure, and the enclosure having a series of successive drying zones. Each drying zone is supplied with a blower as means for supplying and circulating drying gases, such as air or flue gas, at a controllable rate, with means for heating, introducing and circulating the drying gases, control means for sensing the amount of water evaporated and for controlling the rate of evaporation by control of the velocity of at least one of the blowers and the conveyer. Additionally, and as a novel and essential feature of the invention, there is placed an infrared sensor at the exit end of said dryer, the sensor generating a signal related to the moisture level of the veneer exiting said dryer, said signal serving by way of well known electrical signal conversion means to generate an output signal to regulate the velocity of at least one blower in the part of the dryer near the exit.

The placement of the infrared sensor at the outlet of the dryer has several advantages: the strong variations of initial moisture level are, at this point extensively compensated for by the inlet-end control, so that there remain only small variations resulting from measurement errors and uncompensated disturbances at the inlet end. The moisture level is reliably below the fiber saturation point, and indeed, sufficiently far below that a reliable relationship exists between surface temperature and moisture level. The closed regulatory loop takes account of directly as well as indirectly measureable influences, such as differing load, thickness, and wood density.

A preferred means for accurate and stepwise control of the drying in the exit region of the dryer is to have several zones, such as four, and each having a pole-switching type of electrical motor, which can be electrically switched to run faster or slower. Thus, if more or less drying is needed, the requisite number of motors can be successively or simultaneously switched in speed in the necessary direction. This allows for fine stepwise adjustment of the final moisture in an automatic closed-loop manner.

A further advantageous embodiment of the invention is intended to avoid disturbances, or even shut down, of the process when wide deviations occur in the thickness, moisture, or density of a panel. The infrared detector signals are averaged, in groups of, for example three, and the motors are controlled by the averaged signal, so that only if several deviant panels follow in succession, indicating a trend, does the control over motor speed come into effect.

A typical embodiment of the invenition is a tunnel-like enclosure divided into drying zones, each with a blower, heater (radiator), and gas channels for producing and circulating a stream of hot gas around the veneer. The veneer is conveyed, for example on a belt or other conveying device such as a trolley, from zone to zone through the dryer. In at least one, and typically two of the zones, one near the inlet end and one near the middle of the drier, there are (in each zone so provided) two temperature sensors placed before and after the gas stream contacts the veneer so that they give information about the heat demand. A computer, using well known art, processes data from these sensors and generates a control signal to control the velocity of the blowers in the zones near the inlet end and middle of the dryer. To get better control of final moisture content of the veneer, even in the face of wide swings of input variables such as variable wood density, thickness, and initial moisture, the essential feature of the invention is that there is placed at the exit end of the dryer an infrared detector which observes the temperature of the veneer exiting the dryer. This signal can be reliably converted to a control signal for blowers in the zones near the exit end of the dryer, and by means of this control loop the moisture level can be held very close to the target. By use of additional controls over conveyer belt speed, even more extreme excursions can be controlled. Alarm signals can also be added to the system.

BRIEF DESCRIPTION OF THE DRAWING

The above objects, features and advantages of our invention will become more readily apparent from the following description, reference being made to the accompanying highly diagrammatic drawing.

SPECIFIC DESCRIPTION

Figure 1:
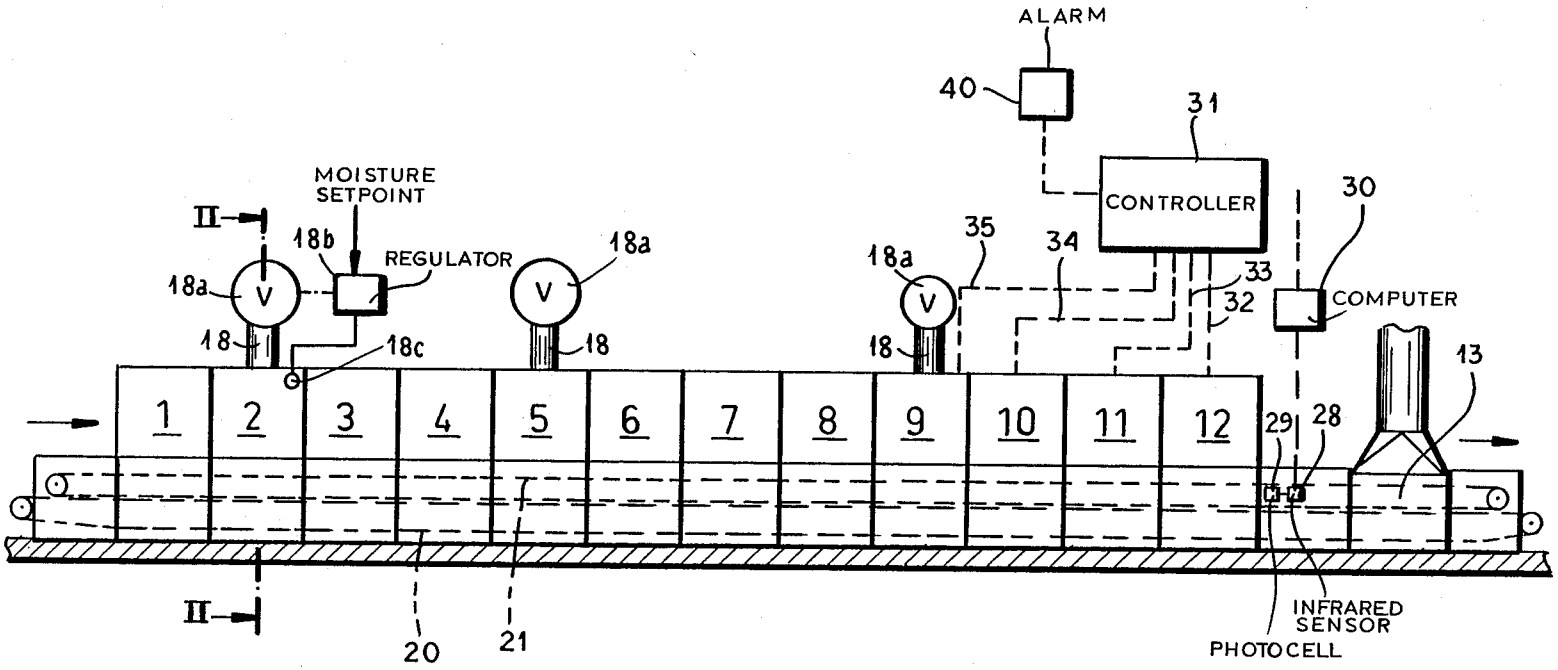
FIG. 1 is a side view of a continuous veneer dryer in accordance with the invention.
Figure 2:
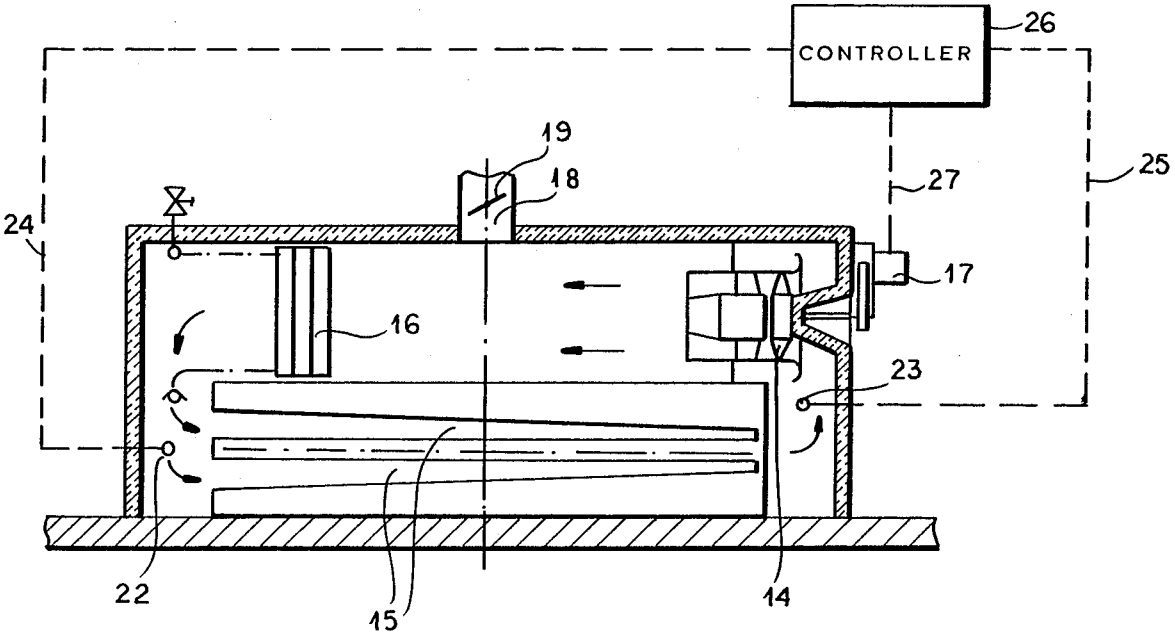
FIG. 2 shows in larger scale a cross section along the line II—II of FIG. 1.

The continuous dryer represented in the drawing comprises in the usual way a number of successive zones 1 to 12. After these, at some distance, there is a cooling zone 13.

Each zone is equipped with a blower 14, with gas conduction channels or jets 15, and with a heating radiator 16. The gas conduction channels bring about, in a known manner, a cross current circulation of heated gas in each zone.

The blowers 14 are driven by pole-switching motors 17 and thus may be driven at either of two selectable speeds.

In the roof of the housing, gas outlet ducts 18 are arranged in zones 2, 5 and 9. Each gas outlet duct 18 is supplied with a damper 18*a* which is operated by a regulator 18*b*. To each regulator 18*b* is supplied an input signal to control its setting, abd a signal proportional to the measured gas moisture, which is generated by a gas moisture measuring device 18*a*.

A transporting device, consisting of a conveyer belt 20 and a covering belt 21, both made of wire mesh, stretches through the entire length of the dryer including the cooling zone 13.

In two zones, one of which is in the vicinity of the inlet and the other in approximately the middle of the dryer, for example in zones 2 and 8, there are temperature measuring sensors 22 and 23 so arranged that the one measures the temperature of the circulated gas before its contact with the veneer sheets, the other one after the contact.

From the sensors 22 and 23 there are conductors 24 and 25 leading to a control apparatus 26, which is connected to a computer or control device (signal processor).

As explained in detail in DE-PS No. 27 21 965, the computer or control device calculates the heat demand from the measured temperatures, taking into account the starting moisture and the load. From this, it calculates in accordance with a presupplied function the requisite gas stream volume for each zone. Accordingly, the value thus calculated is used to control, by means of the conductor 27, the motors 17 of the part of the dryer from the entrance up to zone 8. The motors of zones 9 to 12 of the exit portion of the dryer are independent of the control device 26.

At the dryer exit, between the last dryer zone 12 and the cooling zone 13 there is placed an infrared sensor 28. This consists essentially of a bolometer with a spectral sensitivity in the range of about 2 to 12 microns (although any other type of infrared sensor can be used if it gives an electrical signal), and an electrical convertor which reworks the output signal of the bolometer.

The infrared sensor 28 is controlled by another sensor 29, for example a photocell, so that the infrared sensor is activated by the passage of a veneer sheet.

The signal produced by the infrared sensor 28 is conducted to a computer 30. This carries out a computation taking into account the continuously measured drying conditions, in particular temperature and humidity of the drying gas, making use of an empirically measured formula, and gives an output signal which is conducted to the controller 31, which by way of conductors 32 to 35 regulates the speed of the motors 17 which run the blowers belonging to zones 9 to 12.

The continuous dryer of the invention operates as follows: The temperature of the individual zones are set by hand or by a control apparatus not belonging to the invention; also, the gas moisture and the conveyer belt speed are set. These settings are done in accordance with empirical relationships dependent on the characteristic properties of the veneer sheets to be processed, in particular the thickness and the type of wood. In this basic setting, it is assumed that veneer sheets of average moisture and average thickness are going to be dried to a desired end value.

If the load and the initial moisture do not vary too much from an average value, then the blowers of, for example, zones 1 and 4 run with a higher speed, the blowers of zones 5 to 10 with a lower speed, and the blowers of zones 11 and 12 again with a higher speed. If, now, the heat demand changes due to a changed load or due to a change in initial moisture, then the controller 26 makes a suitable adjustment of the heat input to the part of the dryer corresponding to zones 1 to 8. Upon further demand for heat, first the blower of zones 5 is brought to a higher speed, and finally the series of blowers of zones 6, 7 and 8 as needed. If, on the other hand, the demand for heat lessens, then the blowers of zones 4, 3, 2 and 1 are successively lowered to low speed as necessary. If after switching of all available blowers, a further adjustment is still necessary, the drying time can be changed by adjustment of the conveyer belt speed. The objective of the control sequence just described is to deliver to the veneer sheets as they proceed along the drying pathway from zones 1 to 12, just the right amount of heat altogether so that all of the originally-present water is evaporated, down to a residue of about 3 to 7%. This objective is achieved in the absence of disturbing influences, as a rule, when the blowers in zones 9 and 10 for instance, are running at low velocity and those in zones 11 and 12 with high velocity.

The actual final moisture level of the exiting veneer sheets is measured with the infrared sensor 28. If the final moisture level of several, for example three, veneer sheets in succession is found to be outside the acceptible range, then depending on the direction of the deviation, the velocity of the blower 10 is raised or the velocity of blower 11 is lowered. If necessary, blower 9 or blower 12 is switched also.

In this way, disturbing influences are compensated for, which originate for example in variations of the veneer thickness or the wood density from the norm. In those cases where the changes in blower velocity in zones 9 to 12 of the exit end of the dryer do not suffice for exceptional variations, then by means of the controller 31 an adjustment in conveyer speed and/or a warning signal can be effectuated. The warning signal can be sounded by an alarm 40 triggered by controller 31.

It will be understood that the exit end regulation has the character of a correction process. It is effective in conjunction with a inlet end control tied into the measured heat demand. In this way, even large initial variations can be well controlled.

The operation of the invention does not depend, however, on the measurement of heat demand in accordance with the example given. This methodology is, however, quite advantageous as a rule when large variations occur in load or in initial moisture. If, however, the veneer sheets are of uniform size, for example, precut (shaped) veneer, and fed at a constant rate to the conveyer, the load is constant. In this case, the load can be adjusted for in the original setting and to measure the heat demand, it suffices simply to measure the temperature decline of the ambient gas stream in an individual zone, perhaps in the middle of the drier.

The example given is for purposes of illustration and not to be taken as limiting. It is intended to claim as being within the invention all those new features depicted or herein described.

We claim:

1. A dryer for veneer which comprises an enclosure with an inlet and an exit for veneer and means for moving the veneer from the inlet to the outlet of said enclosure, said enclosure having means for circulating hot gas at a controllable rate for drying the veneer, means for controlling said rate, and, at the exit of said dryer an infrared sensor to determine the residual moisture of said veneer, said sensor supplying an input signal to means for adjusting a hot gas circulation rate in the part of said dryer near the exit.

2. A dryer for veneer which comprises an enclosure, a conveyer for veneer extending through said enclosure, said enclosure having a series of successive zones, each zone supplied with a blower as means for circulating hot gases at a controllable rate, means for heating said gases, control means for sensing the amount of water evaporated and controlling the rate exclusively of evaporation, and additionally an infrared sensor at the exit end of said dryer, said sensor generating a signal related to the moisture level of the veneer exiting said dryer, a computer operationally connected to said infrared sensor to convert the signal for said infrared sensor to an output signal in response to the signal from the infrared detector, a motor controller operationally connected to said computer and controlled by the output signals therefrom, and at least one blower motor operationally connected to said controller and controllable in velocity by said controller, said infrared detector, computer, controller and blower motors together constituting a control loop for maintaining the residual moisture level of veneer exiting said dryer.

3. A dryer for veneer as defined in claim 2 wherein the exit part of the dryer is divided into more than one zone and wherein the blowers of each zone are driven by switchable pole motors, and wherein control means are provided for successively switching the velocity of said motors to control the residual moisture in the veneer exiting said dryer.

4. A dryer for veneer as defined in claim 2 wherein the computer operationally connected to the infrared sensor has means for computing the average of the signal from several successive veneer sheets.

5. A dryer for veneer as defined in claim 3 wherein at least one zone in the part of the dryer from the inlet to the middle of the dryer has temperature sensors placed so as to determine the gas temperature before and after the gas contacts the veneer, signal processing means to convert these measurements to control at least one blower in this part of the dryer, and additionally an infrared sensor at the exit end of said dryer, said sensor generating a signal related to the moisture level of the veneer exiting said dryer, a computer having as input the signal from said infrared sensor together with input indicating the temperature and humidity of the drying gas, said computer having computation means for computing an output signal in response to said inputs, a controller operationally connected to said computer and receiving the output signal from said computer, and blower motors in more than one zone of said dryer near the exit end, said motors being operationally connected to said controller, said controller having means to successively switch the velocity of said motors in response to the signal from said infrared sensor to automatically correct the residual moisture level of veneer exiting said dryer.

6. A dryer for veneer as defined in claim 5 wherein said controller in addition to having means for controlling said blower motors also has means for controlling conveyer velocity in response to greater deviations of moisture level than are controllable by control of said blower motors.

7. A dryer for veneer as defined in claim 6 wherein additionally the controller has means for sounding an alarm when large deviations are sensed by said infrared detector.

8. A method of drying of veneer sheets of uniform size at a constant feed rate in a drying oven having an enclosure which comprises passing said sheets through said enclosure; heating said sheets in said enclosure; measuring of heat demand; setting drying conditions in response to a measurement, and control of residual moisture by exclusively regulating a hot gas circulating rate in said enclosure close to an exit end thereof.

* * * * *